US007282679B2

(12) United States Patent
Reichinger

(10) Patent No.: US 7,282,679 B2
(45) Date of Patent: Oct. 16, 2007

(54) ELECTRICAL CONTACT CONNECTION AND METHOD FOR FORMING SUCH A CONTACT CONNECTION

(75) Inventor: Gerhard Reichinger, Rednitzheimbach (DE)

(73) Assignee: Leoni Aktiengesellschaft, Nuremberg (DE)

( * ) Notice: Subject to any disclaimer, the term of this patent is extended or adjusted under 35 U.S.C. 154(b) by 0 days.

(21) Appl. No.: 11/429,797

(22) Filed: May 8, 2006

(65) Prior Publication Data

US 2006/0201934 A1 Sep. 14, 2006

Related U.S. Application Data

(63) Continuation of application No. PCT/EP2005/005629, filed on May 25, 2005.

(30) Foreign Application Priority Data

Jun. 25, 2004 (DE) ..... 10 2004 030 784

(51) Int. Cl.
*H05B 3/08* (2006.01)
*H01R 4/28* (2006.01)

(52) U.S. Cl. ..... 219/541; 219/543; 219/544; 219/549; 219/553; 439/754; 439/886; 439/887; 439/877; 439/878; 439/879; 174/84 C; 174/90; 29/860; 29/879

(58) Field of Classification Search ..... 219/541, 219/543–4, 549, 553; 29/860, 879; 439/754, 439/886–7, 877–9; 174/84 C, 90
See application file for complete search history.

(56) References Cited

U.S. PATENT DOCUMENTS 3,912,358 A 10/1975 Miller et al.
4,908,943 A 3/1990 Harel et al.

FOREIGN PATENT DOCUMENTS

EP 0 018 863 11/1980
EP 0 966 061 A2 12/1999
GB 755272 8/1956

*Primary Examiner*—Shawntina Fuqua
(74) *Attorney, Agent, or Firm*—Laurence A. Greenberg; Werner H. Stemer; Ralph E. Locher

(57) ABSTRACT

In order to make it possible to produce a secure and permanent contact connection between an electrical conductor made from a soft material, in particular an aluminum conductor, and a contact element made from a harder material, the conductor is encapsulated at least partially in a contact region by an electrically conductive material. The electrically conductive material is harder than the soft material of the conductor. The electrically conductive material is applied with the aid of a thermal spraying process, with the result that there is a pressure-free electrical connection between the soft material and the sprayed-on material. Electrical contact is made with the contact element indirectly via the sprayed-on material. The thermal encapsulation by the spraying in the contact region makes it possible for a reliable electrical contact to be made even in the case of soft materials having a tendency towards cold flow.

15 Claims, 1 Drawing Sheet

ELECTRICAL CONTACT CONNECTION AND METHOD FOR FORMING SUCH A CONTACT CONNECTION

CROSS-REFERENCE TO RELATED APPLICATION

This application is a continuation, under 35 U.S.C. § 120, of copending international application No. PCT/EP2005/005629, filed May 25, 2005, which designated the United States; this application also claims the priority, under 35 U.S.C. § 119, of German patent application No. 10 2004 030 784.9, filed Jun. 25, 2004; the prior applications are herewith incorporated by reference in their entirety.

BACKGROUND OF THE INVENTION

Field of the Invention

The invention relates to an electrical contact connection between an electrical conductor made from a soft material, in particular an aluminum conductor, and a contact element. The invention also relates to a method for forming such a contact connection.

With an electrical contact connection between a soft material, such as aluminum, magnesium or alloys thereof, and a harder material, there is the problem that, when compressed, the soft material yields to the pressure over the course of time, with the result that the electrical connection is weakened and contact problems may result. This property of soft materials of yielding when subjected to pressure is generally referred to as material flow or cold flow.

Owing to this cold flow, there are considerable problems in ensuring secure contact connections between a soft and a hard material which are stable over a long period of time.

SUMMARY OF THE INVENTION

It is accordingly an object of the invention to provide an electrical contact connection and a method for forming such a contact connection which overcomes the above-mentioned disadvantages of the prior art devices and methods of this general type, which provides a secure electrical contact connection between a soft material having a tendency towards cold flow and a further contact element.

With the foregoing and other objects in view there is provided, in accordance with the invention, an electrical contact connection. The electrical contact connection is formed of an electrical conductor made from a soft material and has a plurality of individual conductors, a contact element, and an electrically conductive material encapsulating at least partially a contact region of the electrical conductor. The electrically conductive material is harder than the soft material of the electrical conductor. The electrically conductive material is a sprayed-on material applied with an aid of a spraying process with a result that there is a pressure-free electrical connection between the soft material and the sprayed-on material. Electrical contact is made with the contact element through the sprayed-on material.

The invention provides for an electrical conductor made from a soft material having a tendency towards cold flow to be encapsulated at least partially in its contact region by an electrically conductive material, which is harder than the soft material of the conductor, with the aid of a spraying process. Electrical contact is made with a contact element via the sprayed-on material.

Spraying a harder material onto the electrical conductor has the decisive advantage that an intimate and pressure-free connection is formed between the soft material of the conductor and the harder sprayed-on material applied by a spraying process. Owing to the spraying process, at least some of the sprayed-on hard particles are deposited in the region near to the surface in or on the soft material, with the result that a connection is formed between the soft material and the hard material which is cohesive and is thus permanent. The electrical connection to the contact element is made via the sprayed-on hard material, with the result that in this case a hard-to-hard connection is provided between two materials which do not have a tendency towards cold flow or have only a slight tendency towards cold flow. Electrical contact is therefore made between the conductor and the contact element only indirectly via the sprayed-on material.

A suitable spraying process is, in particular, a thermal spraying process such as hot spraying or preferably flame spraying. As an alternative to this, the material can also be applied by a cold method, for example using so-called cold spraying. In this case, the particles to be sprayed on are not melted on, in contrast to the thermal spraying processes. For the desired intimate connection and effective adhesion between the soft material and the sprayed-on material it is critical that, owing to the thermal and/or kinetic energy of the sprayed-on particles, these particles are anchored permanently in the soft material.

An aluminum conductor, in particular containing a plurality of individual conductors or litz wires, is preferably used as the electrical conductor. In this case, the soft material is understood to be in particular conductive materials made from the elements from the third group of the Periodic Table of the Elements, in particular aluminum, aluminum alloys or magnesium alloys. The hard material is understood to be in particular conductive materials made from elements from the fourth group of the Periodic Table of the Elements, for example copper, nickel, iron, chromium and alloys thereof, in particular chromium/nickel alloys.

In accordance with one expedient refinement, the conductor is completely surrounded circumferentially in the contact region by a sheath which is in the form of a tube and is made from the harder material. The tube is in this case particularly in the form of a hard metal tube and has a high inherent rigidity and dimensional stability, with the result that it has a high mechanical resistance. In this case, the tube is expediently formed from a nickel/chromium/nickel alloy, which has particularly good electrical and mechanical properties.

The contact connection between the sprayed-on material and the contact element is expediently provided via a mechanical pressure connection or clamping connection. The contact connection is in this case formed in particular via a clamping contact or crimping contact. Since in this case the connection is made between two hard materials, there is no risk, or only a very low risk, of cold flow, with the result that, even in the case of a mechanical connection which is subject to pressure, permanently secure electrical contact-making is ensured. Secure contact-making is ensured, in particular in conjunction with the dimensionally stable and inherently rigid sheath in the form of a tube.

The conductor expediently has, at one end, a contact cross-sectional area which is larger than the conductor cross-sectional area and onto which the conductive material is sprayed. For this purpose, the conductor is preferably beveled at one end. The front end of the conductor is therefore encapsulated by the conductive material by spraying, which preferably forms a type of end cap. Owing to the increase in size of the contact cross-sectional area compared to the normal cross-sectional area, an effective contact area which is as large as possible is achieved for current transfer.

This is particularly advantageous in DC applications or in applications with alternating current at a low frequency, since in these cases the so-called skin effect does not occur or barely occurs and current transfer takes place over the entire conductor cross-sectional area. A contact connection which does not include the entire cross-sectional area of the conductor would result in a very high contact resistance. In contrast to this, current transfer, in particular at high-frequency alternating currents, only takes place in the outer region near to the surface, the "skin" of the conductor, with the result that the conductor core does not contribute to current transfer. Since a connection which covers 100% of the area between the soft material and the sprayed-on hard material is not necessarily formed when the material is sprayed on, owing to the increase in size of the contact cross-sectional area, the effective contact area, i.e. the area in which actual contact is made between the sprayed-on material and the soft material, is increased and is, for example, 100% of the normal conductor cross-sectional area. The contact resistance is thus kept as low as possible. In this case, the normal conductor cross-sectional area is understood to be the cross-sectional area which is formed by a perpendicular section with respect to the longitudinal extent of the conductor.

The increase in size of the contact cross-sectional area owing to the beveled section is particularly advantageous in particular in the case of a conductor having a large cross-sectional area and/or a conductor containing a plurality of litz wires.

The increase in the contact cross-sectional area is in principle also advantageous in other types of contacts, for example when making contact with a conductive adhesive, when making contact with an elastic, conductive material, which is pressed against the conductor, or in the case of soldered connections.

The conductor is expediently an aluminum battery cable, in particular for a motor vehicle, and the contact element is a battery terminal. In the motor vehicle sector, conductors made from aluminum are increasingly used in order to save on weight. In particular in the case of a battery cable which has a very large cross section owing to the high currents and therefore has a very high weight when, for example, copper is used, the use of an aluminum cable results in that a relatively considerable saving can be made on weight. Owing to the electrical contact connection described here between such an aluminum battery cable and the battery terminal, a secure and permanent connection between the aluminum cable and the battery is ensured.

The preferred developments and advantages outlined in terms of the electrical contact connection can expediently also be used for the method.

The in particular thermal spraying process is in this case expediently selected, and the spraying parameters are set, such that the conductive material at least partially penetrates the conductor and at least partially passes through an oxide layer which may be provided on the conductor surface. In particular when making contact with an aluminum conductor, there is generally the problem that the aluminum conductor has an insulating oxide skin, which would lead to a very high contact resistance in the case of a normal clamping connection. Owing to the fact that the conductive material penetrates the conductor and owing to the material connection, associated therewith, between the soft material and the hard material, the aluminum oxide layer does not influence, or hardly influences, the contact resistance. A material connection is in this case understood to mean the introduction of hard material into the soft material of the conductor such that the hard particles are partially surrounded by the soft material.

In order to form the electrical contact connection, the conductor is expediently encapsulated by the conductive material by spraying and, at the same time, the electrical contact connection between the conductive material and the contact element is formed. The electrical contact connection is therefore formed in a single-step operation merely by the conductive material being sprayed on which, at the same time, at least partially covers the conductor and the contact element.

As an alternative to this, one preferred refinement provides for a two-step procedure, in which, in a first step, the conductive material is sprayed onto the contact region of the conductor and, in a second step, contact is made with the contact element in particular by a mechanical clamping connection or pressure connection. In this case, the sheath, which is in particular in the form of a hard metal tube and is made from the conductive material, is expediently constructed by the contact region being encapsulated by spraying a plurality of times.

Other features which are considered as characteristic for the invention are set forth in the appended claims.

Although the invention is illustrated and described herein as embodied in an electrical contact connection and a method for forming such a contact connection, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
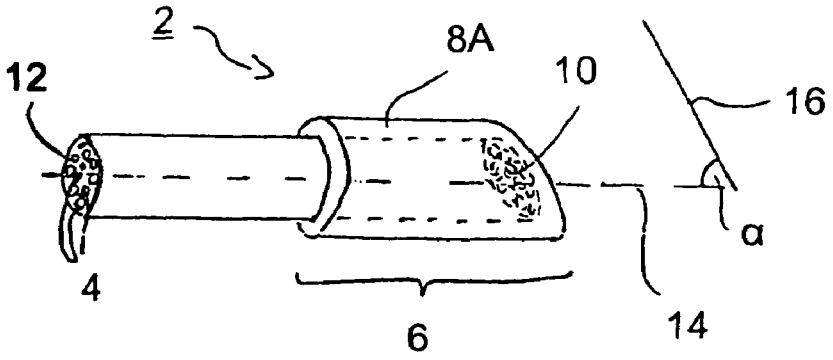
FIG. 1 is a diagrammatic, side perspective view of a conductor, which is made from a soft material and is beveled at one end, having a sprayed-on end cap, according to the invention.

In all the figures of the drawing, sub-features and integral parts that correspond to one another bear the same reference symbol in each case. Referring now to the figures of the drawing in detail and first, particularly, to FIG. 1 thereof, there is shown an end, from which insulation has been stripped, of a conductor 2, which is in particular in the form of an aluminum conductor. The conductor 2 has a large number of individual conductors 4, in the form of, in particular, litz wires. The conductor 2 is, for example, a battery cable which is envisaged for use in a motor vehicle.

At one end, the conductor 2 is surrounded in a contact region 6 by a sheath 8A, which is in the form of an end cap and is made from a harder material than the aluminum conductor 2.

The sheath 8A is applied with the aid of a thermal spraying process, for example hot spraying or so-called flame spraying. Owing to the fact that the harder material is sprayed onto the soft material of the conductor 2, a secure, permanent and in particular pressure-free connection is produced between these two materials, with the result that there is no risk of the connection is impaired by cold flow of the material of the conductor 2.

In particular, a nickel/chromium/nickel alloy is selected as the material for the sheath 8A. The sheath 8A is in this case formed with a sufficiently great wall thickness by being sprayed over a plurality of times such that the sheath 8A has, overall, a high inherent rigidity and thus dimensional stability. The sheath 8A is therefore in the form of a rigid tube.

The conductor 2 is beveled obliquely at one end such that a planar, approximately ellipsoidal contact cross-sectional area 10 is formed in a second end region. The contact cross-sectional area 10 has an enlarged area compared with the normal circular conductor cross-sectional area 12 in the case of a circular conductor. Owing to the increase in size of the contact cross-sectional area 10, only low contact resistance is achieved in particular in applications in which there is no skin effect, for example in DC applications.

In this case, an angle a between a conductor longitudinal axis 14 and the bevel 16 is preferably a maximum of approximately 60°, as is illustrated in FIG. 1. The smaller the angle is selected to be, the greater the contact cross-sectional area 10.

Figure 2:
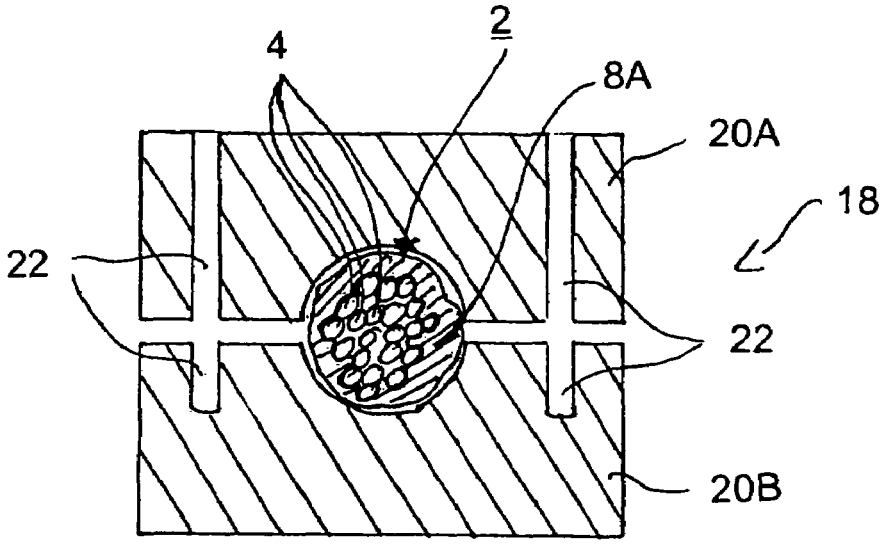
FIG. 2 is a diagrammatic, sectional view through a contact terminal, in the form of a battery terminal, having a conductor inserted.

In the exemplary embodiment shown in FIG. 2, in particular the conductor 2 shown in FIG. 1 is inserted into a terminal in the form of a battery terminal 18. The terminal is a contact element for the purpose of making contact with the conductor 2. The battery terminal 18 has two clamping halves 20A, 20B, between which the conductor 2 and the sheath 8A are inserted. In order to form the contact connection, the two clamping halves 20A, 20B are tensioned with respect to one another via non-illustrated screws which engage in screw receptacles 22, with the result that the conductor 2 is mechanically clamped in the battery terminal 18. The electrical contact connection is in this case provided indirectly via the sheath 8A, which surrounds the individual conductors 4 completely circumferentially. By correspondingly selecting the material and the wall thickness of the sheath 8A, the sheath is preferably configured such that the individual conductors 4, with which contact has been made via the sheath 8A, are essentially pressure-free even when they are clamped in the battery terminal 18.

Figure 3:
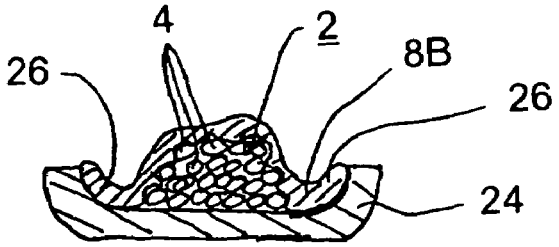
FIG. 3 is a diagrammatic, sectional view showing a contact connection, which is formed in a single-step spraying process, between a contact element and a conductor.

In contrast to this, in the exemplary embodiment shown in FIG. 3 the electrical contact connection is configured such that the individual conductors 4 are initially placed onto a contact element 24 in the form of a shell and then have the harder material sprayed over them. In this case, a sheath 8B is formed which partially surrounds the individual conductors 4 and which, with its flanks 26, at the same time enters into a connection with the surface of the contact element 24, in particular a cohesive connection. The individual conductors 4 are therefore enclosed between the contact element 24 and the sheath 8B.

The contact element 24 is in this case in the form of a crimping sleeve, for example, which is also deformed, i.e. after the sheath 8B has been sprayed onto, in order to also achieve a mechanical fixing of the sheath 8B.

In accordance with one preferred alternative refinement, a mechanical fixing element is provided for additional mechanical fixing purposes which tensions the sheath 8B with respect to the contact element 24. The fixing element is, for example, a screw which is screwed into an associated screw hole provided with a thread in the base of the contact element 24. The individual conductors 4 would in this case pass around the centrally disposed screw. As an alternative to this, it is possible to provide a central sleeve which is connected to the base of the contact element 24 and which has, for example, an outer thread, onto which a nut is screwed for clamping fixing purposes. In this case, the contact elements 24 are expediently configured such that they can be disposed one above the other and can be stacked such that two or more connection planes are provided. For this purpose, for example, a first contact element 24 with a base-side opening is plugged or screwed onto the mentioned sleeve of a further contact element.

Provision is furthermore expediently made for the total height of the contact element 24, including the individual conductors 4 and the sheath 8B, not to exceed a predefined maximum total height in order for it to be possible to insert the contact element with the individual conductors, with which contact has been made, for example, into a predefined flat sleeve. The maximum total height is, for example, determined by the height of the trough-like contact element 24, when seen in cross section.

I claim:

1. An electrical contact connection, comprising:

an electrical conductor made from a soft material and having a plurality of individual conductors;

a contact element; and an electrically conductive material encapsulating at least partially a contact region of said electrical conductor 92), said electrically conductive material being harder than said soft material of said electrical conductor, said electrically conductive material being a sprayed-on material applied with an aid of a spraying process with a result that there is a pressure-free electrical connection between said soft material and said sprayed-on material, and electrical contact being made with said contact element through said sprayed-on material.

2. The contact connection according to claim 1, wherein said electrical conductor is completely surrounded circumferentially in said contact region by said sprayed-on material and said sprayed-on material forms a sheath.

3. The contact connection according to claim 2, wherein said sheath is made from an Ni/Cr/Ni alloy.

4. The contact connection according to claim 1, wherein a mechanical pressure connection or clamping connection is formed between said sprayed on material and said contact element.

5. The contact connection according to claim 1, wherein said electrical conductor has a first end with a first contact cross-sectional area being larger than a second conductor cross-sectional area, said sprayed-on material is sprayed onto a region of said second conductor cross-sectional area.

6. The contact connection according to claim 5, wherein said electrical conductor is beveled at one end.

7. The contact connection according to claim 1, wherein:

said electrical conductor is an aluminum battery cable; and said contact element is a battery terminal.

8. The contact connection according to claim 1, wherein said electrical conductor is an aluminum conductor.

9. The contact connection according to claim 7, wherein said aluminum battery cable is a motor vehicle battery cable.

10. A method for producing an electrical contact connection between a conductor made from a soft material and a contact element, which comprises the steps of:

encapsulating the conductor at least partially over a contact region of the conductor with an electrically conductive material being harder than the soft material of the conductor, the electrically conductive material being a sprayed-on material applied by a thermal spraying process resulting in a pressure-free connection formed between the soft material and the sprayed-on material; and making electrical contact with the contact element through the sprayed-on material.

11. The method according to claim 10, which further comprises applying an oxide layer to a surface of the conductor and the electrically conductive material at least partially penetrates the conductor and at least partially passes through the oxide layer.

12. The method according to claim 10, which further comprises encapsulating the conductor with the electrically conductive material being sprayed on and, at a same time, the electrical contact between the electrically conductive material and the contact element is formed.

13. The method according to claim 10, which further comprises in which, in a first step, spraying on the electrically conductive material onto the contact region of the conductor and, in a second step, making the electrical contact between the contact element and the conductor by one of a mechanical clamping connection and a pressure connection.

14. The method according to claim 13, which further comprises forming a sheath made from the electrically conductive material by the contact region being encapsulated by a spraying on process performed a plurality of times.

15. The method according to claim 13, which further comprises forming the conductor as an aluminum conductor.

* * * * *